US008308323B2

(12) United States Patent
Holland

(10) Patent No.: US 8,308,323 B2
(45) Date of Patent: Nov. 13, 2012

(54) MAGNETIC LIGHT CLIP

(76) Inventor: Darryl Holland, Lubbock, TX (US)

( * ) Notice: Subject to any disclaimer, the term of this patent is extended or adjusted under 35 U.S.C. 154(b) by 130 days.

(21) Appl. No.: 12/885,300

(22) Filed: Sep. 17, 2010

(65) Prior Publication Data

US 2012/0069587 A1 Mar. 22, 2012

(51) Int. Cl.
*F21V 21/08* (2006.01)

(52) U.S. Cl. ..... 362/396; 362/391; 362/398

(58) Field of Classification Search ..... 362/39, 362/398, 252, 644, 647, 652, 391, 806, 396
See application file for complete search history.

(56) References Cited

U.S. PATENT DOCUMENTS 5,110,078 A 5/1992 Gary
5,893,628 A 4/1999 Byers
6,176,600 B1 * 1/2001 Huang ..... 362/396
6,367,952 B1 * 4/2002 Gibboney, Jr. ..... 362/249.05
7,513,643 B2 4/2009 Williams
7,549,779 B2 * 6/2009 Genenbacher ..... 362/398
2006/0138293 A1 6/2006 Clement
2009/0185370 A1 7/2009 Moore

* cited by examiner

*Primary Examiner* — Ali Alavi

(74) *Attorney, Agent, or Firm* — George M. Tompkins; Tompkins P.C.

(57) ABSTRACT

A light clip is disclosed comprising: a base; a magnet attached to the base; two or more strand engagement members extending from the base, wherein a space is defined between the two or more strand engagement members, and the space is of sufficient size so that a bulb socket may be positioned between two or more strand engagement members; and a groove defined in each of the strand engagement members; the groove configured to engage a cord.

6 Claims, 4 Drawing Sheets

MAGNETIC LIGHT CLIP

TECHNICAL FIELD OF THE INVENTION

The present invention is generally directed to clips for attaching decorative lights to structures.

BACKGROUND ART OF THE INVENTION

People commonly decorate houses, buildings and other structures with strands of lights, particularly during the Holidays. Many methods and apparatus have been used to secure light strings to structures. One commonly-used method is to attach a string of lights using a plastic clips with tabs that slip under shingles on a roof. However, this method is unacceptable for installation on structures which do not have roof shingles or where the shingles are glued to the roof surface. In particular, this solution does not work with metal roofs or roofs with edge flashing.

Other solutions have been proposed which use magnets. One such solution is described in U.S. Pat. No. 7,549,779, issued to Genenbacher. Genenbacher discloses light sockets with built-in magnets for attaching the sockets to metal surfaces. However, the Genenbacher fixture requires purchase of light strands pre-configured with magnetic bases and cannot be used with third-party light strands. Further, the Genenbacher fixture only facilitates orientation of light bulbs in a single direction with respect to the metal surface. Another solution using magnets is disclosed in U.S. Patent Publication No. 2009/0185370 ("Moore"). However, the Moore clip also fails to allow users to select a bulb orientation. Further, the Moore clip is not particularly compact or sturdy. Another solution is disclosed in U.S. Patent Publication No. 2006/0138293 ("Clement"). However, the Clement clip does not provide any mechanism for bulb orientation and it is also not sufficiently compact or sturdy.

What is needed is a light mounting solution capable of attaching to a variety of metal surfaces and which can be used with an existing string of lights. Preferably, the solution should allow the user to select between two or more mounting orientations. The solution is preferably of simple construction and is both compact and sturdy.

SUMMARY OF THE INVENTION

The above-mentioned needs are addressed by a light clip comprising a base; a magnet attached to the base; two or more strand engagement members extending from the base, wherein a space is defined between the strand engagement members and the space is of sufficient size so that a bulb socket may be positioned between two or more strand engagement members; and a groove defined in each of the strand engagement members; the groove configured to engage a cord.

In one embodiment, the light clip further comprises a substantially planar mounting surface on the base.

In another embodiment, the grooves are configured so that, when a bulb socket is placed between the strand engagement members, and a cord of the bulb socket is positioned in the grooves, the bulb socket will remain oriented so that a bulb extending from the bulb socket will extend in a direction perpendicular to the mounting surface.

In another embodiment, the grooves are configured so that, when a bulb socket is placed between the strand engagement members, and a cord of the bulb socket is positioned in the grooves, the bulb socket will remain oriented so that a bulb extending from the bulb socket will extend in a direction parallel to the mounting surface.

In another embodiment, the light clip comprises a second groove defined in each of the strand engagement members; wherein the first grooves are configured so that, when a bulb socket is placed between the strand engagement members, and a cord of the bulb socket is positioned in the first grooves, the bulb socket will remain oriented so that a bulb extending from the bulb socket will extend in a direction parallel to the planar surface; and wherein the second grooves are configured so that, when a bulb socket is placed between the strand engagement members, and a cord of the bulb socket is positioned in the second grooves, the bulb socket will remain oriented so that a bulb extending from the bulb socket will extend in a direction perpendicular to the planar surface.

DETAILED DESCRIPTION OF THE PREFERRED EMBODIMENT

Figure 1:
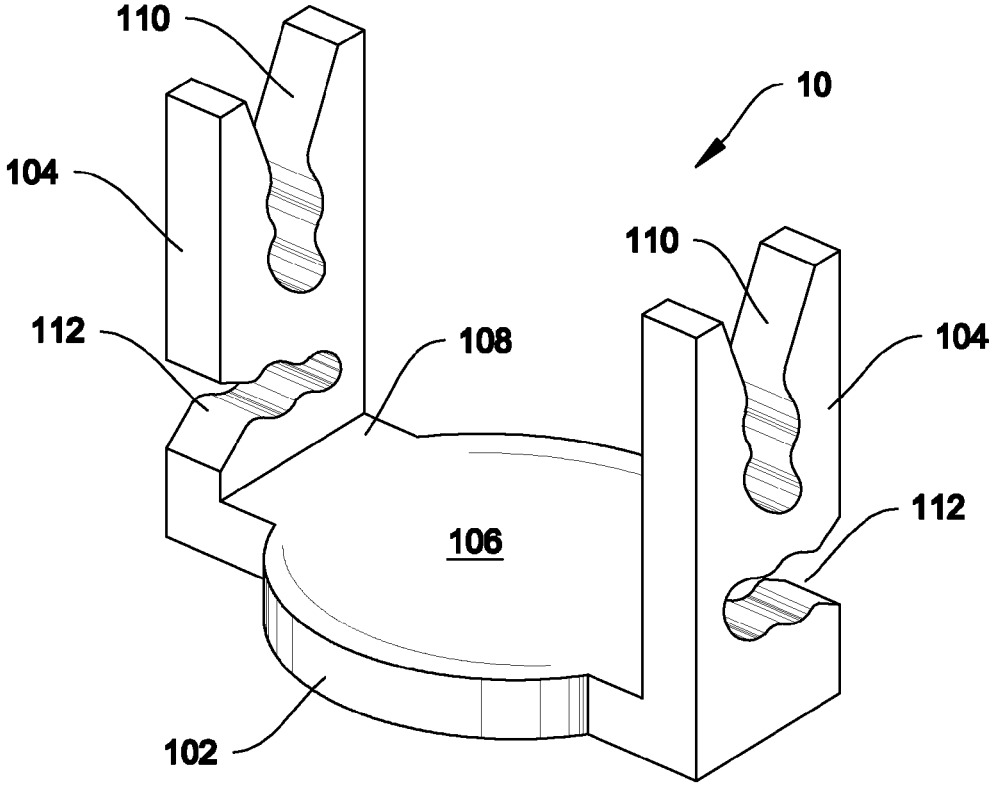
FIG. 1 is a perspective view of a light clip.

Referring to FIG. 1, a light clip 10 is shown. Light clip 10 generally includes base 102 and one or more strand engagement members 104. Preferably, base 102 is in a shape generally comprising a disk 106 with extension members 108 extending from opposing sides of disk 106. Many other shapes and configurations for base 102 may be used, although generally planar shapes are preferred to provide stability to light clip 10. Strand engagement members 104 are preferably attached to extension members 108 and protrude perpendicularly from base 102.

Figure 2:
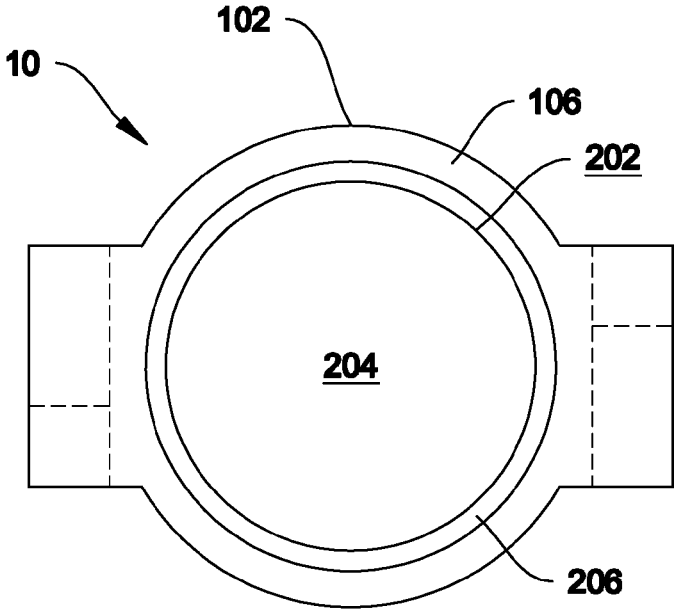
FIG. 2 is a bottom view of a light clip.

FIG. 2 shows a bottom-view of clip 10. A circular indention 202 is defined in a center of disk 106. Preferably a magnet 204 is positioned in circular indention 202 defined in disk 106. Magnet 204 is preferably pressed into indention 202 under pressure and is held in place by friction, but may also be glued or secured in another manner. Alternatively, other shapes of magnets may be used. Surrounding magnet 204 and circular indention 202 is spacer ring 206. As may be seen in FIG. 3, spacer ring 206 preferably extends perpendicularly from base 102 for approximately 0.5 mm. The slight extension of spacer ring 206 from base 102 protects surfaces on which light clip 10 may be installed from being scratched by magnet 204. Alternatively, a circular indention may be defined in a top surface of base 102 and magnet 202 may be positioned in the circular indention from the top. In that case, a thin sheet of the material forming base 102 will preferably remain in the bottom of circular indention to support magnet 204 and protect the installation surfaces from scratches.

Figure 3A:
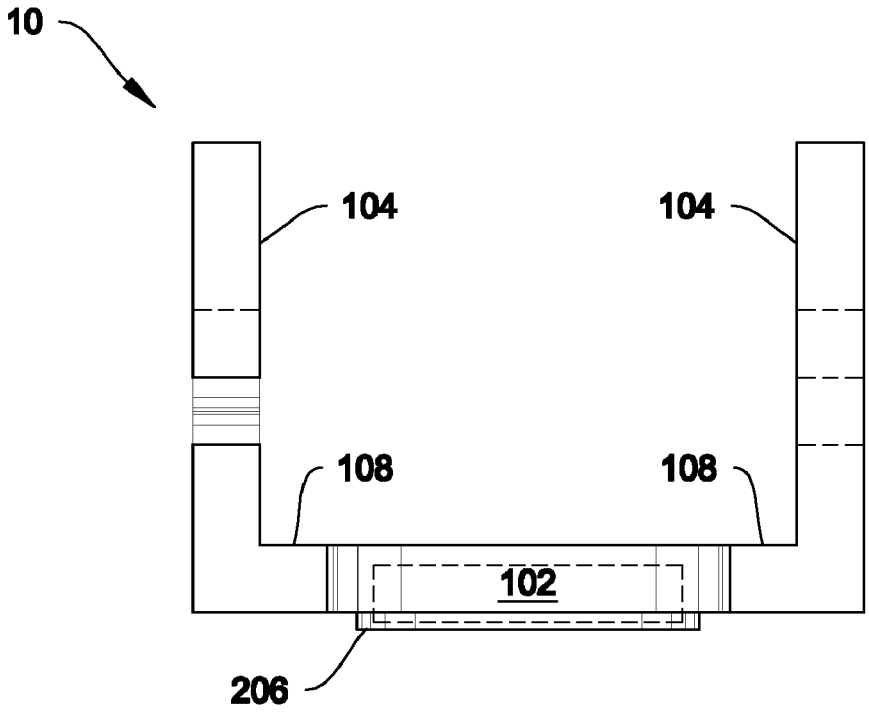
FIGS. 3A and 3B are front views of two embodiments of a light clip.
Figure 3B:
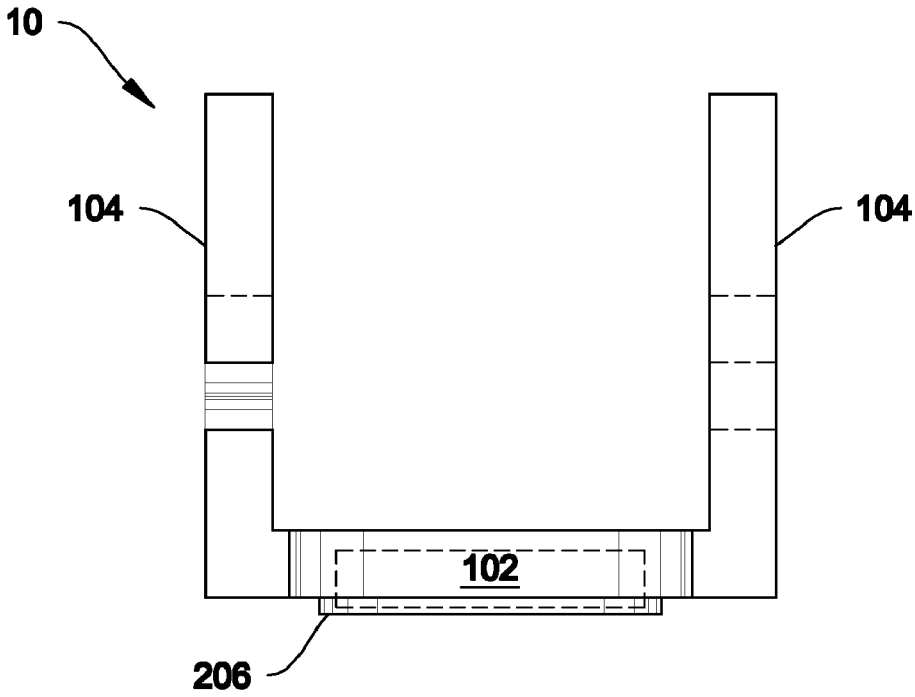

FIG. 3A is a side view of light clip 10. FIG. 3B shows a variation of light clip 10. In FIG. 3B, clip 10 is shown with no extension members 108. Preferably, a light clip 10 as shown in FIG. 3A would be used in connection with a C9 bulb, and a light clip as shown in FIG. 3B would be used in connection with a C7 bulb.

Figure 4:
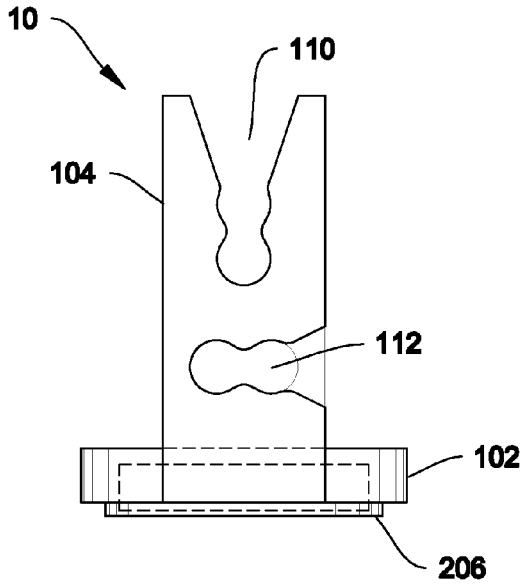
FIG. 4 is a side view of a light clip.
Figure 5:
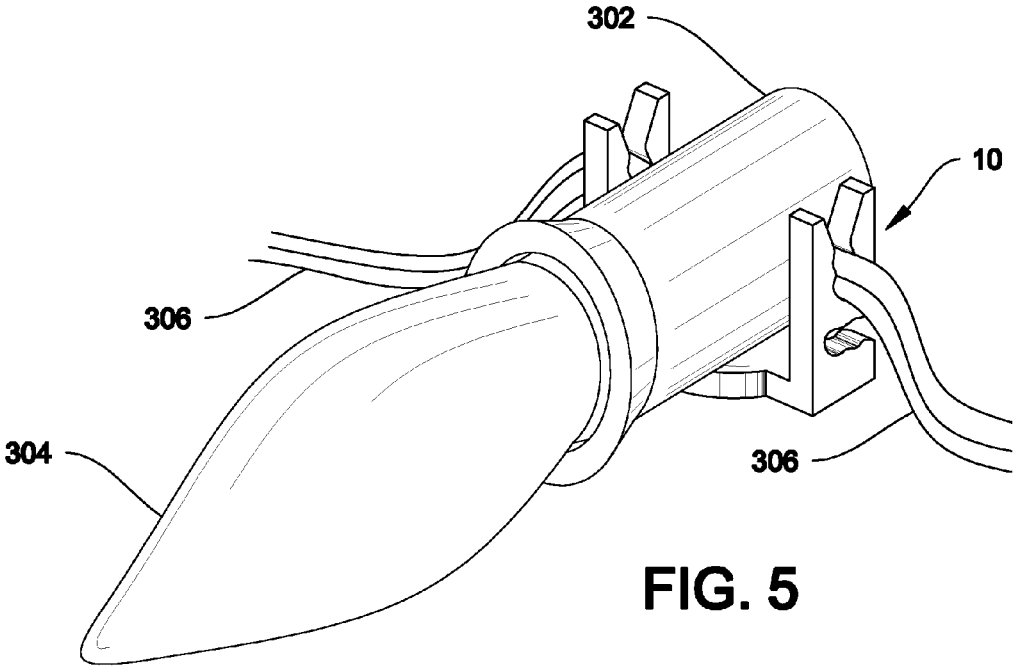
FIG. 5 is a perspective view of a light clip holding a light bulb.
Figure 6:
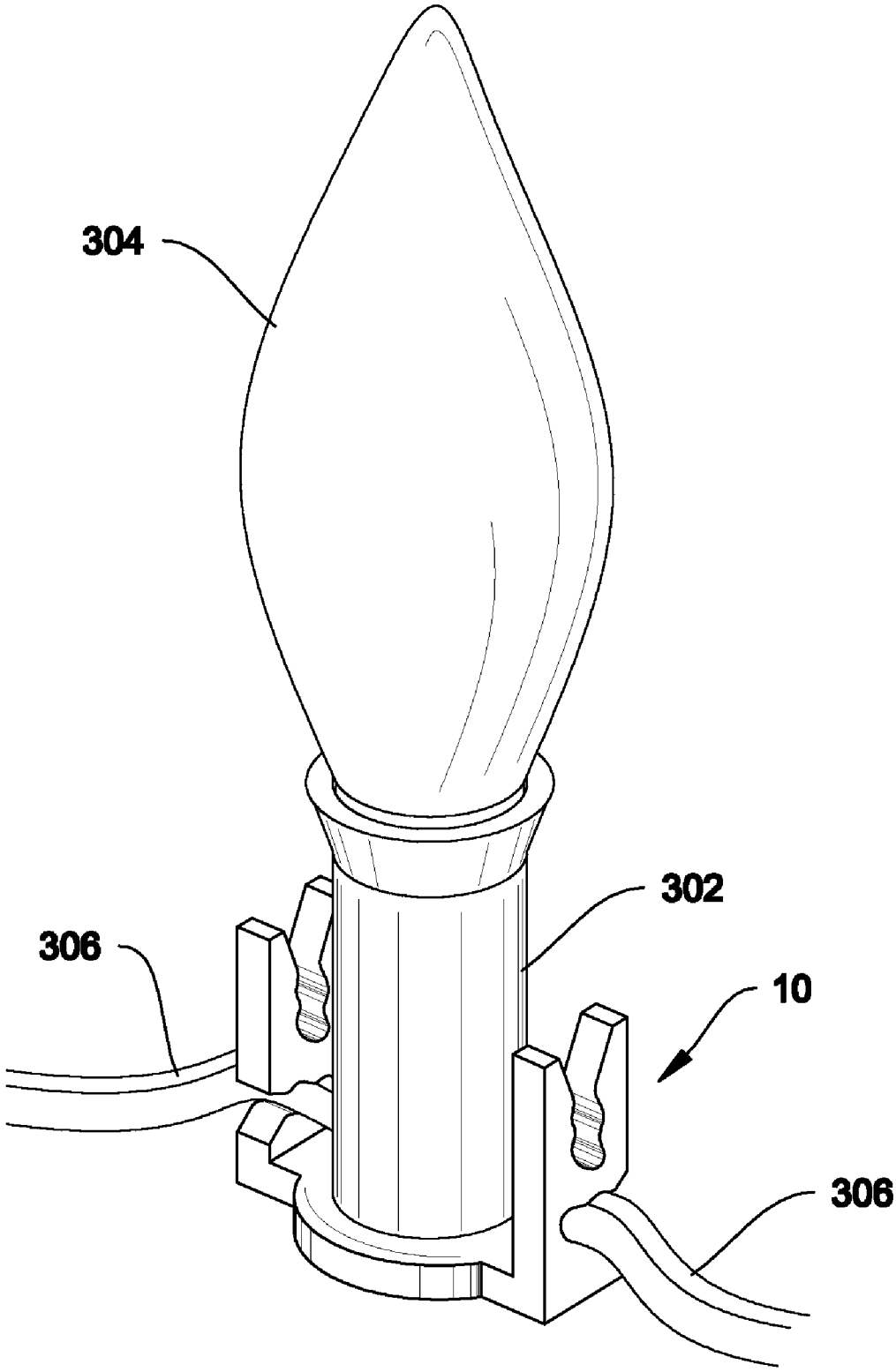
FIG. 6 is a perspective view of a light clip holding a light bulb.

Strand engagement members 104 comprise one or more strand grooves. Preferably, strand engagement members 104 each comprise two strand grooves: an upper groove 110 defined perpendicularly to base 102, and a lower groove defined parallel to base 102. Upper grooves 110 and lower grooves 112 may be seen in more detail in FIG. 4. Upper grooves 110 and lower grooves 112 are preferably configured to engage a two-wire cord of the type generally used with strands of C7 or C9 decorative lights. As may be seen in FIG. 5, upper grooves 110 are preferably located so that, when a strand of C7 or C9 decorative lights are engaged in upper grooves 110 of strand engagement members 104, a bulb socket 302 located between strand engagement members 104 will be held in a position that allows a bulb 304 to extend from light clip 10 in a direction parallel to base 102. As may be seen in FIG. 6, Lower grooves 112 are preferably located so that, when a strand of C7 or C9 decorative lights are engaged in lower grooves 112 of strand engagement members 104, a bulb socket 302 located between strand engagement members 104 will be held in a position that allows a bulb 304 to extend from clip 10 in a direction perpendicular to base 102. As may be seen in FIG. 1, Lower grooves 112 are preferably oriented in opposite directions to decrease the likelihood of the bulb strand escaping from light clip 10. The position of upper grooves 110 and lower grooves 112 will depend on the size of the light sockets that light clip 10 is intended to hold, and on where the cord attaches to the light sockets. Alternatively, strand engagement members 104 may be configured to engage other wire types, such as a strand of mini lights.

Disk 106, extension members 108, and strand engagement members 104 may be molded together as one unit, preferably of a durable, but inexpensive material such as plastic, most preferably polypropylene. The collective unit may be manufactured by injection molding. Magnet 204 is preferably a neodymium magnet with a thickness of approximately 2-3 mm and a diameter of approximately 15 mm. Preferably, a slightly thicker magnet 204 would be used in connection with heavier bulbs, such as C9 bulbs, and a slightly thinner magnet 204 would be used in connection with smaller bulbs, such as C7 bulbs. Additionally, many other magnets are known and may be used.

To use light clip 10, a user preferably places a bulb socket 302 between two strand engagement members. If a bulb 304 is being mounted parallel to base 102, the user clips a strand cord 306 into lower grooves 112. If bulb 304 is being mounted perpendicularly to base 102, the user clips the strand cord 306 into upper grooves 110. After clipping a bulb socket 302 into light clip 10, light clip 10 may be installed simply by placing it on any surface comprising a metal that is attracted by magnets (e.g. ferrous metals).

Although the invention has been described with reference to specific embodiments, this description is not meant to be construed in a limiting sense. Various modifications of the disclosed embodiments, as well as alternative embodiments of the inventions, will be apparent to persons skilled in the art upon reference to the description of the invention. It is, therefore, contemplated that the appended claims will cover such modifications that fall within the scope of the invention.

I claim:

1. A light clip for attaching a strand of decorative lights to a structure, the light clip comprising:

a base;

a magnet attached to the base;

two or more strand engagement members extending from the base, wherein a space is defined between two or more strand engagement members, and the space is of sufficient size to allow a bulb socket to be positioned between two or more strand engagement members; and a groove defined in each of the strand engagement members; the groove configured to grip a cord to secure at least a portion of a strand of lights.

2. The light clip of claim 1 further comprising a substantially planar mounting surface on the base.

3. The light clip of claim 2 wherein the grooves are configured so that, when a bulb socket is placed between the two or more strand engagement members, and a cord of the bulb socket is positioned in the grooves, the bulb socket will remain oriented so that a bulb extending from the bulb socket will extend in a direction perpendicular to the mounting surface.

4. The light clip of claim 2 wherein the grooves are configured so that, when a bulb socket is placed between the two or more strand engagement members, and a cord of the bulb socket is positioned in the grooves, the bulb socket will remain oriented so that a bulb extending from the bulb socket will extend in a direction parallel to the mounting surface.

5. The light clip of claim 2 further comprising:

a second groove defined in each of the strand engagement members;

wherein the first grooves are configured so that, when a bulb socket is placed between the two or more strand engagement members, and a cord of the bulb socket is positioned in the first grooves, the bulb socket will remain oriented so that a bulb extending from the bulb socket will extend in a direction parallel to the planar surface; and wherein the second grooves are configured so that, when a bulb socket is placed between the two or more strand engagement members, and a cord of the bulb socket is positioned in the second grooves, the bulb socket will remain oriented so that a bulb extending from the bulb socket will extend in a direction perpendicular to the planar surface.

6. The light clip of claim 2 wherein the grooves are configured so that, when a bulb socket is placed between the two or more strand engagement members, and a cord of the bulb socket is positioned in the grooves, the bulb socket will remain oriented in a fixed direction relative to the planar surface.

* * * * *